US008186526B2

(12) United States Patent
Branson et al.

(10) Patent No.: US 8,186,526 B2
(45) Date of Patent: May 29, 2012

(54) CHILD RESISTANT CLOSURE WITH A STACKING POSITION

(75) Inventors: Mark Branson, Newburgh, IN (US); Brian Brozell, Maumee, OH (US); Paul Zurawick, Holland, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 384 days.

(21) Appl. No.: 12/499,126

(22) Filed: Jul. 8, 2009

(65) Prior Publication Data

US 2011/0006030 A1 Jan. 13, 2011

(51) Int. Cl.
*B65D 55/02* (2006.01)

(52) U.S. Cl. ..... 215/220

(58) Field of Classification Search ..... 215/217, 215/219, 220

See application file for complete search history.

(56) References Cited

U.S. PATENT DOCUMENTS

| | | | |
|---|---|---|---|
| 3,260,393 | A | 7/1966 | Roberts et al. |
| 3,343,697 | A | 9/1967 | Roberts et al. |
| 3,853,236 | A | 12/1974 | Ostrowsky |
| 3,888,375 | A | 6/1975 | Gerk |
| 3,917,098 | A | 11/1975 | Acton et al. |
| 4,037,747 | A | 7/1977 | Acton et al. |
| 4,319,690 | A | 3/1982 | Birrell et al. |
| 4,353,474 | A | 10/1982 | Luker |
| 4,371,088 | A | 2/1983 | Gach |
| 4,555,036 | A | 11/1985 | Bekkers et al. |
| 4,588,098 | A | 5/1986 | Uzdy |
| 4,632,264 | A | 12/1986 | Evans |
| 4,673,095 | A | 6/1987 | Puresevic et al. |
| 4,729,487 | A | 3/1988 | Wright |
| 5,762,215 | A | 6/1998 | Ogden |
| 5,893,473 | A | 4/1999 | Morris, Sr. |
| 6,158,604 | A | 12/2000 | Larguia, Sr. et al. |
| 2004/0099627 | A1 | 5/2004 | Yan |
| 2005/0121406 | A1 | 6/2005 | Brozell et al. |

OTHER PUBLICATIONS

U.S. Patent and Trademark Office, The International Search Report and the Written Opinion of the International Searching Authority, or the Declaration, Search Report and Written Opinion, Sep. 20, 2010, pp. 1-9, PCT International Patent Application No. PCT/US2010/041310, U.S. Patent and Trademark Office, Alexandria, VA, USA.

*Primary Examiner* — Anthony Stashick
*Assistant Examiner* — James N Smalley
(74) *Attorney, Agent, or Firm* — Middleton Reutlinger; Chad D. Bruggeman; John F. Salazar

(57) ABSTRACT

A child resistant closure having an outer cap and an inner cap combined together. The caps are provided with complementary engaging ratcheting teeth making it possible to turn the caps as a unit in a closing direction but permits relative rotation of the caps upon rotation of the outer cap in an opening direction unless the outer cap is simultaneously deflected axially relative to the inner cap. Complementary load bearing surfaces are provided on the caps to prevent axial deflection when the caps are in a predetermined position and the caps resist rotation from this predetermined position.

21 Claims, 5 Drawing Sheets

CHILD RESISTANT CLOSURE WITH A STACKING POSITION

TECHNICAL FIELD

The present invention relates to a child resistant closure and particularly to a child resistant closure with a stacking position.

DETAILED DESCRIPTION

Figure 1:
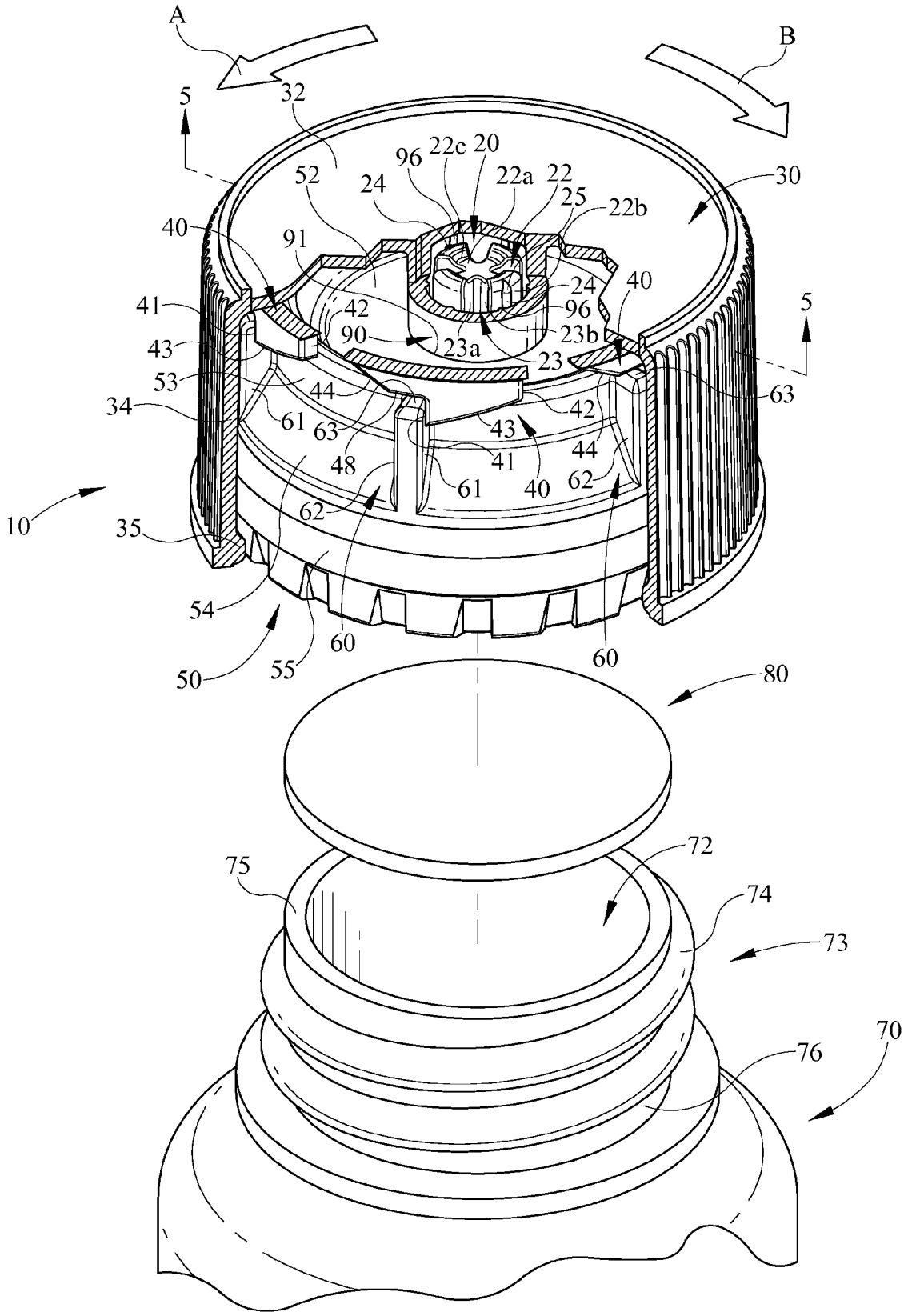
FIG. 1 is a top perspective view of the closure according to one embodiment with portions of the outer cap and container partially broken away and the closure and liner exploded away from the container.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

The child resistant closure 10 is provided with a inner cap 50 and an outer cap 30 permitting closing of a container 70 by turning the caps as a unit but which permit relative rotation in an opening or closure-removing direction A thereby precluding removal of the closure. In addition to rotation, removal requires axial deflection of one cap relative to the other to engage complementary driving elements permitting rotation of the caps as a unit and therefore removal from a container. Proper functioning of such closures requires that the deflectable outer cap returns to its original, as molded position after removal from and replacement on a container. These closures are naturally indexed into the stacking position (FIGS. 1 and 5) after assembly of the closure to the container to ensure that the outer cap can not be pushed down into engagement with the inner cap. However, after containers are filled and closed for the first time, they frequently are packed in stacks in boxes for shipment or are displayed in stacks for marketing purposes. Such stacked loading of the containers and closures subjects the packages to large vertical loads which otherwise could distort and permanently deflect the outer cap of the closures to a position in which any twisting movement could loosen or remove the caps from the container thereby destroying the child resistant feature. In addition, stacking or shrink banding a closure that does not have a stacking position may overcome the spring back feature of the child resistant closure and result in a non-child resistant configuration.

Child resistant closure 10 according to one embodiment of the present invention depicted in the FIGS. 1-5 has outer cap 30 and inner cap 50 structured to provide at least one adequate child resistant mechanism. The child resistant mechanism discourages access to the contents of the container by children and others unable to recognize the danger. The outer cap 30 and inner cap 50 have an operable ratchet teeth engagement mechanism requiring a push and turn to overcome the safety feature and permit the opening of the closure 10.

As shown in FIG. 1, container 70 may generally have an elongated cylindrical shape, but it is not limited to such and may be of a variety of shapes that best contain the product or have the greatest aesthetic appeal. As shown in FIG. 1, container 70 has a shoulder narrowing to a container neck finish 73 comprising a neck 76 that is of sufficient length to accommodate an external thread 74 for threaded engagement of child resistant closure 10 with the container. At the top of the neck 76 is an opening 72 surrounded by rim 75 permitting access to the contents of container 70. Container 70 may be of unitary construction and made of any of numerous materials commonly known in the art depending on specific product and environmental conditions. Some common examples of materials include but are not limited to polyethylene, polypropylene, and polyethylene terephthalate. Container 70 is merely representative of containers in general, and it is to be understood that there are a variety of containers of different shape, size, and neck finish that may be used with the push and turn closure embodiments herein.

Figure 3:
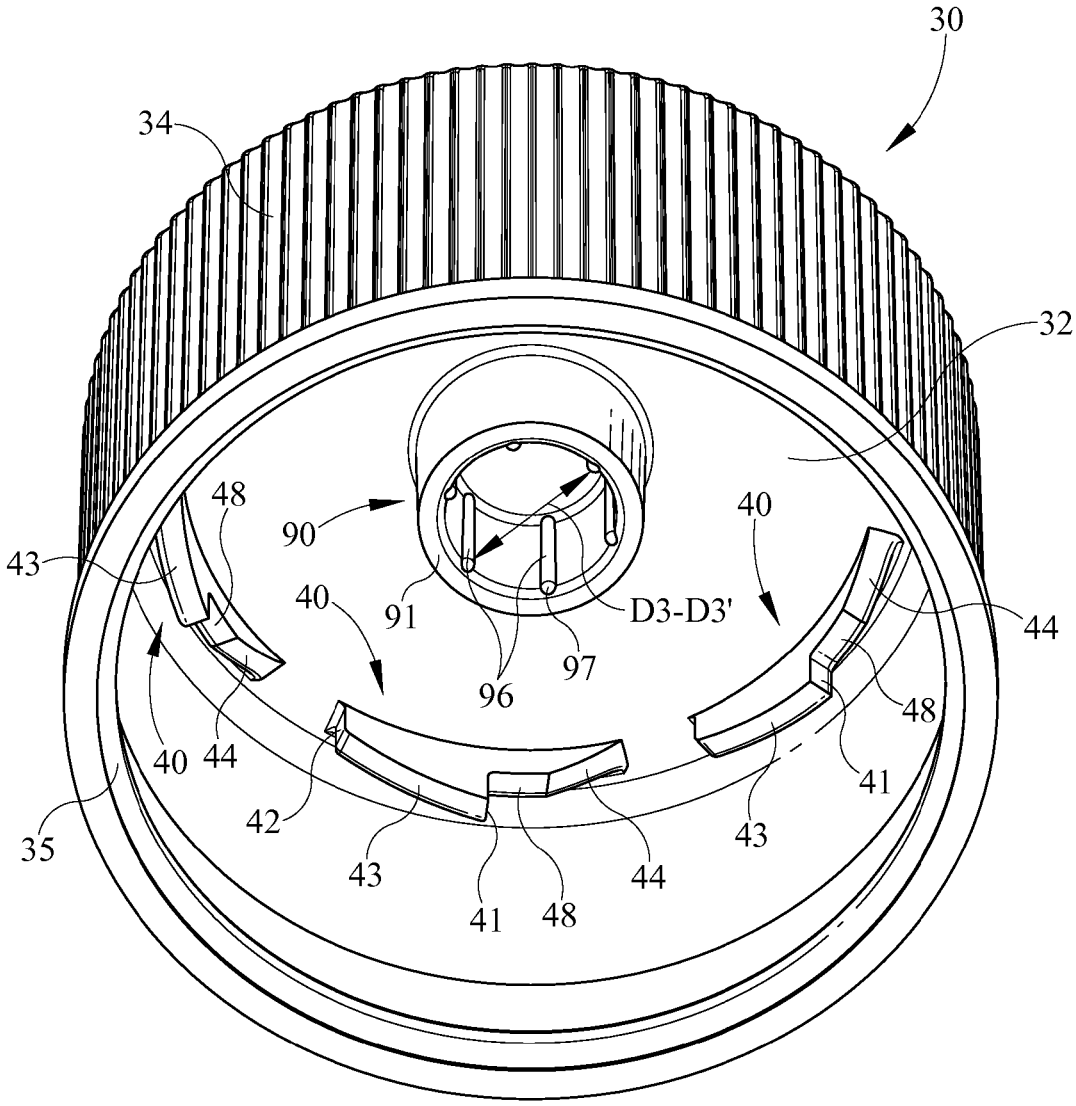
FIG. 3 is a bottom perspective view of the outer cap of the closure of FIG. 1.
Figure 5:
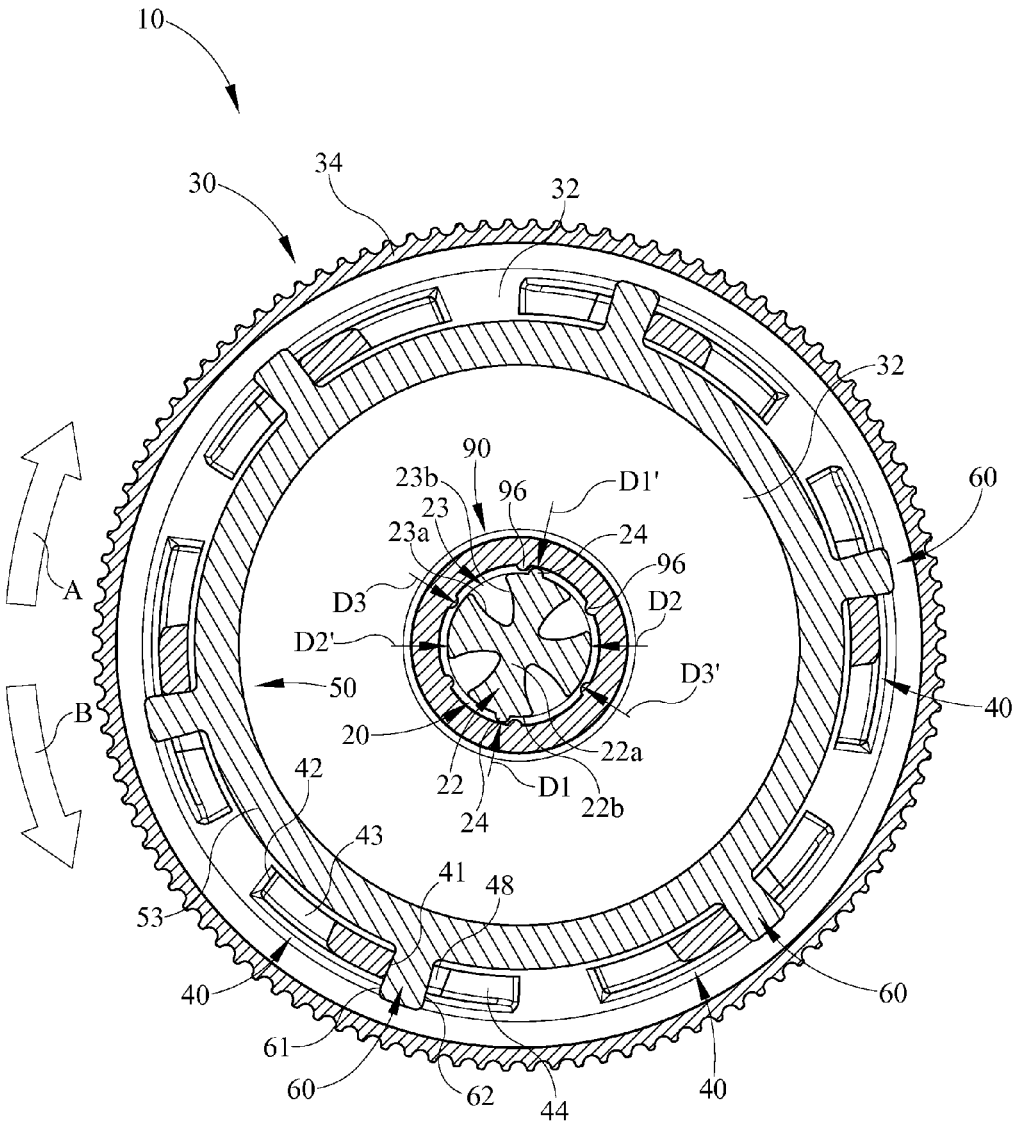
FIG. 5 is a sectional view of the inner cap and outer cap of the closure of FIG. 1 taken along line 5-5.

As shown in FIGS. 1, 3, and 5, closure 10 includes outer cap 30. Outer cap 30 has a top wall 32 and a peripheral or depending skirt 34 therearound. As shown in FIGS. 1 and 3, skirt 34 has a radially inwardly directed retaining rim 35 shaped to hold an inner cap 50 within outer cap 30 after assembly. Ratchet teeth 40 may project from top wall 32 or interconnect with top wall 32 and skirt 34 of outer cap 30. However, a plurality of ratchet teeth 40 may be arranged about the inner circumference of cap skirt 34. Each of ratchet teeth 40 of outer cap 30 may include an on-drive surface 41 and an off-drive surface 42.

As shown in FIGS. 1, 2, 4, and 5, closure 10 also includes inner cap 50. Inner cap 50 includes a top wall 52 with a peripheral or depending skirt 54 therearound. In addition, inner cap 50 may include a sealing liner 80 (FIG. 1) for sealing against the rim 75 of container 70 when closure 10 is engaged therewith. An interior surface of inner cap 50 includes an internal thread (not shown) for cooperatively engaging against the threaded neck 73 of container 70. Inner cap 50 has an annular rim 53 formed integrally with top wall 52. A plurality of teeth 60 are formed on the outer surface of the skirt 54 and rim 53 to extend generally axially and have an upper surface 63 at the same level as the rim 53. Teeth 60 are uniformly spaced circumferentially of inner cap 50, with six being illustrated in the drawings spaced 60 degrees apart. Inner cap skirt 54 includes a plurality of ratchet teeth 60 arranged about the outer circumference of skirt 54. However, the ratchet teeth 60 may project from top wall 52 or project from both top wall 52 and skirt 54 of inner cap 50. Inner cap 50 is sized to be disposed within outer cap 30 and retained therein by rim 35. Skirt 54 of inner cap 50 is somewhat shorter than skirt 34 of outer cap 30, so that limited axial displacement is possible between the inner cap and the outer cap. The inner cap 50 and outer cap 30 are disposed concentrically in nested relationship and the skirt 34 is provided with a radially inwardly directed rim 35 which is engageable with a radially outwardly extending flange 55 on inner cap 50 to permit limited axial movement of the outer cap 30 and inner cap 50 but maintain them in assembled and nested relationship. Ratchet teeth 40 of outer cap 30 are shaped for operable engagement with ratchet teeth 60 of inner cap 50. However, because of the loose mounting of inner cap 50 within outer cap 30, outer cap 30 may be rotated freely with respect to inner cap 50 without interengagement of their respective ratchet teeth when the closure members are sufficiently axially displaced from each other.

As shown in FIG. 1, liner 80 is sized to nest against the interior surface of top wall 52 of inner cap 50. Liner 80 acts as a seal between closure 10 and rim 75 of container neck finish 73 when closure 10 is engaged with neck finish 73 of container 70. Various types of liners 80 may be used including re-seal liners, liners made of malleable seal materials or air permeable materials, foil seals, or other seals known to those skilled in the art. Alternatively, a plug seal (not shown) may depend from the interior surface of top wall 52 and/or skirt 54 of the inner cap 50 and serve to seal-in the contents of container 70 without need for additional liners, malleable seal materials, foil seals or other types of seals for seating the closure in contact with the container neck finish, as is well known in the art.

As shown in FIGS. 1 and 5, ratchet teeth 40 of outer cap 30 are put in operable engagement with ratchet teeth 60 of inner cap 50 when closure 10 is pushed down to become engaged with container 70. When minimal force is applied downwardly to outer cap 30 while turning it in the closure-applying direction B, on-drive surface 41 of outer cap ratchet teeth 40 engage ratchet teeth 60 of inner cap 50 to screw closure 10 onto container neck finish 73. In the embodiment shown in FIGS. 1, 3, and 5, the on-drive surface 41 of ratchet teeth 40 is generally perpendicular to the plane of top wall 32, and off-drive surface 42 is also perpendicular to the plane of the top wall 32. Each of ratchet teeth 60 of inner cap 50 also include a surface 61 generally perpendicular to the plane of inner cap top wall 52. Because on-drive surface 41 of each of ratchet teeth 40 is generally perpendicular to the plane of top wall 32, outer cap ratchet teeth 40 may easily make the necessary engagement with the generally perpendicular surface 61 of inner cap ratchet teeth 60 upon application of a minimal downwardly directed force to screw closure 10 onto container neck finish 73.

The application of a downwardly directed pushing force to outer cap 30 while turning it in the closure-removing direction A will produce an effect which depends on the magnitude of the applied force. If the force is great enough, the off-drive surfaces 42 of outer cap ratchet teeth 40 will be tightly engaged against surfaces 62 of inner cap ratchet teeth 60 and the turning of the outer cap will operate to unscrew closure 10 from container neck finish 73. If, on the other hand, an insufficient axial pushing force is applied to outer cap 30, as may normally occur when turned by a child, off-drive surfaces 42 and inclined surfaces 43 of each ratchet tooth 40 will slide across the upper surface 63 of the distal edge of the ratchet teeth 60. This sliding motion will, of course, be accompanied by normal upward axial displacement of outer cap 30 from inner cap 50 as inclined surfaces 43 slide across the upper surfaces 63 of each of teeth 60. The difference in length between skirt 54 of inner cap 50 and skirt 34 of outer cap 30 allows this axial displacement to occur as successive ratchet teeth 40 of outer cap 30 slide over successive ratchet teeth 60 of inner cap 50 without imparting a turning movement to the inner cap, thus producing the desired child resistant feature.

Ratchet teeth 40 are formed integrally with outer cap 30 adjacent the junction of top wall 32 and skirt 34. Ratchet teeth 40 correspond in number and spacing to teeth 60 on inner cap 50. Both outer cap teeth 40 and inner cap teeth 60 are annularly aligned in that the annulus on which the teeth 40 are located is approximately the same diameter as the annulus on which the teeth 60 are located. In that manner, the outer cap skirt 34 and rim 53 form an annular zone therebetween in which the teeth 60 and teeth 40 are located. It will be understood by one skilled in the art that there are a variety of ratchet teeth that may be used to operably engage the outer cap and inner cap in a child resistant mechanism while still providing a stacking position.

As shown in FIGS. 1 and 3, each of the ratchet teeth 40 extends arcuately between rim 53 of the inner cap 50 and the outer cap skirt 34. Each of teeth 40 has a pair of oppositely facing surfaces 42 and 41 with the forward surface 42 having a slightly larger axial extent than the forward inclined surface 44. Teeth 60 of inner cap 50 will slide down inclined surface 44 of each ratchet tooth 40 to engage on-drive surface 41 when outer cap 30 is turned in the closure-applying direction B. In addition, when the closure 10 is in its initially closed condition or stacking position as illustrated in FIGS. 1 and 5 of the drawings, the forward inclined surface 44 extends downwardly to the height of upper surface 63 of teeth 60. Teeth 40 each have on-drive surface 41, and an adjoining pad surface 48, which respectively engage the surface 61 of each of teeth 60 and upper surface 63 thereof. The on-drive surface 41 and the off-drive surface 42 of each ratchet tooth 40 are joined by an inclined cam surface 43.

Figure 2:
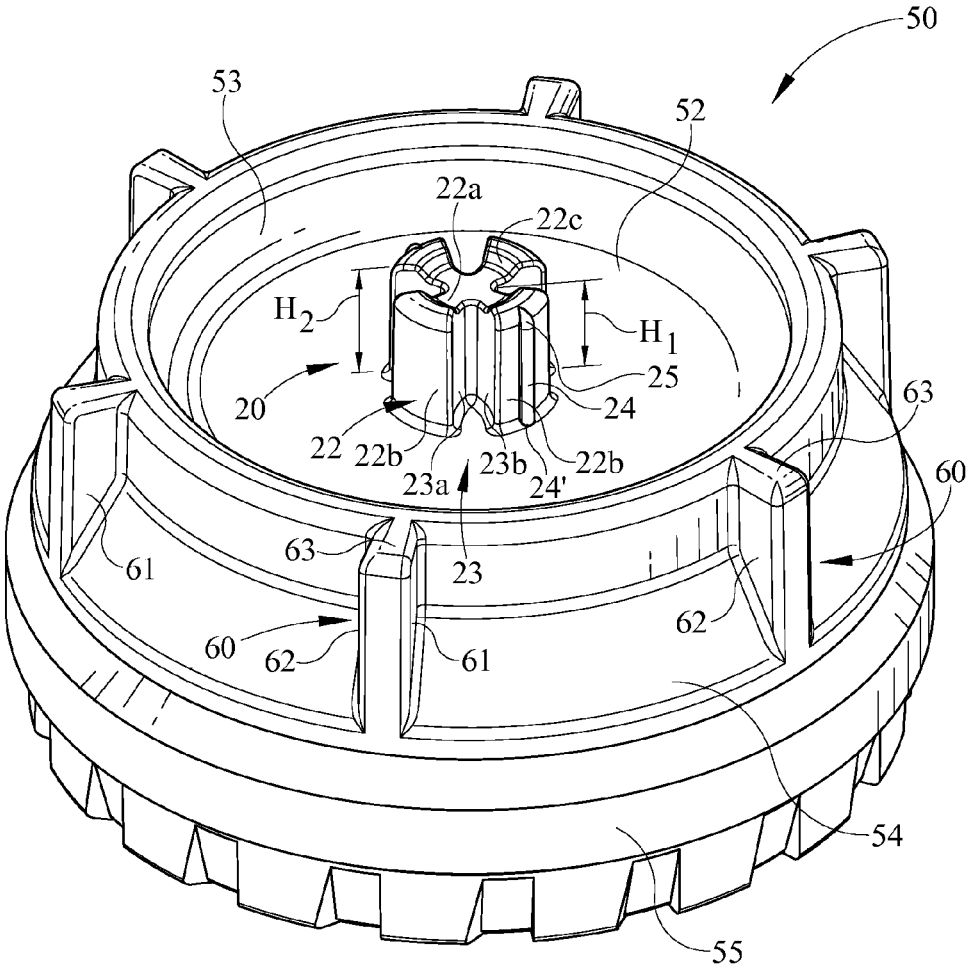
FIG. 2 is a top perspective view of the inner cap of the closure of FIG. 1.

As shown in FIGS. 2 and 3, inner cap 50 and outer cap 30 are held apart at their axes by spacer means in the form of telescoping collar 90 formed on outer cap 30 and central post 20 formed on inner cap 50. The collar 90 and central post 20 are respectively coaxial with the inner cap 50 and outer cap 30 and serve to maintain the axial relationship of the inner cap and outer cap along the central axis of closure 10. Collar 90 and central post 20 are respectively provided with axially extending ribs 96 and detents 24. Ribs 96 and detents 24 extend radially toward each other as seen in FIGS. 1-5 and will interfere with each other upon relative rotation of collar 90 and central post 20.

As shown in FIGS. 1, 2, 4, and 5, the central post 20 extends vertically from the top surface of inner cap top wall 52. Central post 20 has two or more arcuate flanges or projections 22 annularly positioned about the central post. As best shown in FIG. 2, each of said arcuate projections 22 has a distal end **22*a* spaced from the central axis of post 20 and from an arcuate outer edge 22*b*. Each adjacent distal end 22*a* and arcuate outer edge 22*b* together define the top end of a pair of arcuate sidewalls 23*a* and 23*b* which extend downward from the side of adjacent arcuate outer edges 22*b*. Each pair of arcuate sidewalls 23*a* and 23*b* are positioned between adjacent arcuate projections 22 to define an elongated concave recess 23 therebetween. Concave recesses 23 may have depths of various dimensions but are here shown as being of a constant depth spaced away from the central axis of inner cap 50. As shown in FIG. 2, distal end 22*a* of each arcuate projection 22 has a first height H1 measured from the top surface of the inner cap top wall 52, and each arcuate outer edge 22*b* has a second height H2 as measured from the top surface of inner cap top wall 52. The second height H2 is larger than first height H1, thereby defining an arcuate surface 22*c* between the respective distal end 22*a* and arcuate outer edge 22*b*. As a result central post 20** has a concave top surface.

Figure 4:
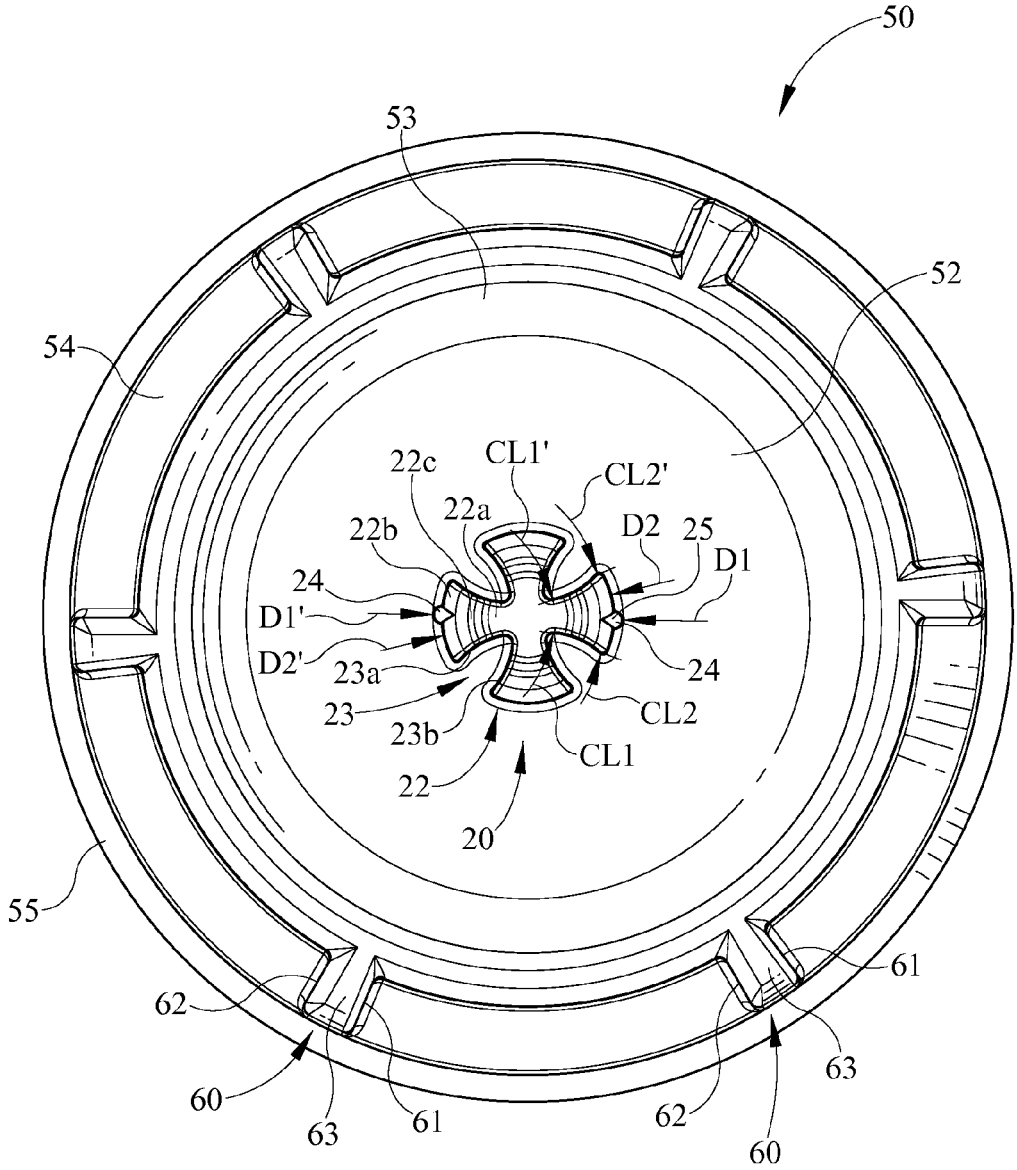
FIG. 4 is a top view of the inner cap of FIG. 1.

Further, as shown in FIG. 4, distal end 22*a* has a first circumferential length CL1-CL1' and arcuate outer edge 22*b* has a second circumferential length CL2-CL2', with the second circumferential length being larger than the first circumferential length.

As shown in FIGS. 1, 2, 4, and 5, arcuate outer edge 22*b* of one or more arcuate projections 22 has a substantially vertical detent 24, although it is contemplated that the detent may be non-vertical. Detent 24 projects from arcuate outer edge 22*b* for substantially the full length or height H2 of central post 20. However it is contemplated that each detent 24 may extend over only a portion of the arcuate outer edge 22*b* leaving the bottom edge 24' spaced from inner cap top wall 52 at a variety of selected distances. The distal end 25 of detent 24 may be tapered as shown in FIG. 2 to lead the central post into engagement with the collar 90 of outer cap 30. Arcuate outer edge 22*b* adjacent the top surface of each arcuate projection 22 may also be tapered or rounded to lead the central post into engagement with collar 90. Also, as shown in FIGS. 4 and 5, the outer diameter D2-D2' of the arcuate outer edges 22*b* of two opposing arcuate projections 22 is smaller than the outer diameter D1-D1' of detents 24 of two opposing arcuate projections 22. Stated alternatively, detent 24 is positioned at a larger radius from the central axis of central post 20 than arcuate outer edge 22*b* of the arcuate projection.

As shown in FIGS. 3 and 5, the distal free end 91 of collar 90 and/or the ends 97 of the plurality of ribs 96 may be tapered or rounded to lead collar 90 into engagement with central post 20. The plurality of axial ribs 96 of collar 90 are positioned at an inner diameter D3-D3' that is smaller than outer diameter D1-D1' of detents 24 so as to allow axial ribs 96 and detents 24 to interfere with each other upon relative rotation of collar 90 and central post 20 thereby maintaining a stacking position relationship (FIGS. 1 and 5) of the collar 90 and the central post 20. Although the collar and central post are shown as being substantially vertical in relation to each other, the surfaces of either or both of the collar and the central post may be substantially non-vertical. For instance, the recess 23 between two arcuate projections 22 or the arcuate outer edge 22*b* of the arcuate projection may be tapered inwardly towards the top surface of the central post.

As shown in FIG. 1, in order to screw child resistant closure 10 onto a threaded container neck finish 73 such as neck 76, outer cap 30 is held by a person or an automatic capping machine, not shown, and closure 10 is moved into contact with and rotated relative to neck 76. The torque of rotation is thus transmitted from outer cap 30 to inner cap 50 by means of on-drive surfaces 41 on teeth 40 simultaneously engaging the side surfaces 61 of teeth 60 as seen in FIGS. 1 and 5. Sufficient torque can be applied so that liner or seal 80 comes into tight sealing engagement with container rim 75 of neck 76.

Upon application of child resistant closure 10 to neck 76 of container 70 for the first time after the associated container has been filled, on-drive surface 41 on teeth 40 are in engagement with teeth 60 so that inner cap 50 and outer cap 30 turn as a unit to bring the threads into engagement with each other. In doing so, closure 10 can be tightened on neck 76 to bring about sealing engagement between liner 80 (if a liner is desired in the application) and rim 75 of the neck 76. In that condition or stacking position, as best seen in FIGS. 1 and 5, pad surface 48 of teeth 40 is in engagement with upper surface 63 of teeth 60. As a consequence, axial loads such as those that would be encountered if containers are stacked one upon the other are absorbed by teeth 60 so that there is no deformation of the relatively deflectable outer cap 30. At the same time that pad surfaces 48 are in engagement with upper surfaces 63 of teeth 60, the small interfering ribs 96 and detents 24 bear the relationship seen in FIGS. 1 and 5. Under those conditions the axial ribs 96 and detents 24 engage each other to prevent relative rotation of the collar 90 and central post 20 and therefore relative rotation of outer cap 30 and inner cap 50. This insures that the pad or stack surfaces 48 of teeth 40 remain in engagement and axial alignment with upper surfaces 63 of teeth 60.

The relative dimensions and surfaces of the collar 90 and central post 20 as well as axial ribs 96 and detents 24 can be accurately controlled so that the force resisting relative movement of inner cap 50 and outer cap 30 can be sufficient to insure that the inner cap 50 and outer cap 30 maintain the desired stacking relationship (FIGS. 1 and 5) during packing, handling, shipping and unpacking for display. However, when it is desired to remove closure 10 from the container 70, outer cap 30 is easily moved relative to inner cap 50 by applying only the modest force necessary to overcome the detent 24 and rib 96 abutting relationship in the stacking position, without loosening the inner cap 50. Even a child is capable of thusly turning outer cap 30 in the closure-removing direction A. However, in that instance unless outer cap 30 is axially deflected to bring off-drive surfaces 42 into engagement with the side surfaces 62 of teeth 60, the outer cap 30 can be ratcheted and rotated relative to inner cap 50 without transmitting the torque necessary to remove it from the container.

It is understood that while certain embodiments of the invention have been illustrated and described, it is not limited thereto except insofar as such limitations are included in the following claims and allowable functional equivalents thereof.

We claim:

1. A child resistant closure and container combination comprising:

a container having a container neck, said container neck having an opening defined by a rim;

a child resistant closure having an outer cap operably engaging an inner cap, said outer cap having a top wall and a first plurality of ratchet teeth and said inner cap having a top wall and a second plurality of ratchet teeth;

said first plurality of ratchet teeth and said second plurality of ratchet teeth being positionable between an on-drive position and an off-drive position, wherein an on-drive surface of said first plurality of ratchet teeth engages a corresponding first surface of said second plurality of ratchet teeth when in said on-drive position, said on-drive position permits said outer cap and said inner cap to turn as a single unit in a closing direction on said container, wherein an off-drive surface of said first plurality of ratchet teeth engages a corresponding second surface of said second plurality of ratchet teeth when in said off-drive position, said off-drive position permits said outer cap and said inner cap to turn as a single unit in an opening direction along with an axial deflection of said outer cap relative to said inner cap removing said child resistant closure from said container;

a load bearing engagement between axially aligned teeth surfaces of each of said inner cap and said outer cap prevents axial displacement of said inner cap and said outer cap when said first plurality of teeth and said second plurality of teeth are in said on-drive position;

a collar projecting downwardly from a bottom surface of said outer cap top wall, a plurality of axial ribs projecting from an inner surface of said collar;

a central post projecting upward from a top surface of said inner cap top wall, said central post having two or more arcuate projections equidistantly spaced about said central post, each of said arcuate projections having a distal end spaced from a central axis of said central post and an opposing arcuate shaped outer edge;

said distal end of each said arcuate projection having a first circumferential length and said arcuate shaped outer edge having a second circumferential length, wherein said second circumferential length is larger than said first circumferential length;

at least one of said arcuate projections having an axial detent projecting from said arcuate shaped outer edge; and said axial detent of said at least one arcuate projection positioned at a first radius from said central axis of said central post and each of said plurality of axial ribs of said outer cap collar positioned at a second radius from said central axis, wherein said first radius of said axial detent is larger than said second radius of each of said plurality of axial ribs thereby said axial detent of said at least one arcuate projection operably engages said plurality of axial ribs of said outer cap collar to resist rotation of said inner cap and said outer cap.

2. The child resistant closure and container combination as in claim 1 wherein each one of two opposing said arcuate projections having said axial detent projecting from said arcuate shaped outer edge.

3. The child resistant closure and container combination as in claim 1 wherein said distal end of each said arcuate projection has a first height away from said top surface of said inner cap top wall and said arcuate shaped outer edge has a second height away from said top surface of said inner cap top wall, wherein said second height is larger than said first height.

4. The child resistant closure and container combination as in claim 1 wherein each said arcuate projection further comprising a pair of opposing sidewalls connecting said distal end to said arcuate shaped outer edge, each one of said pair of opposing sidewalls is arcuate in shape and defining a concave recess between adjacent said arcuate projections.

5. The child resistant closure and container combination as in claim 1 wherein said axial detent of said at least one arcuate projection includes a distal end tapered away from said inner cap top wall.

6. The child resistant closure and container combination as in claim 1 wherein a distal end of said inner surface of said outer cap collar and each of said plurality of axial ribs is tapered away from said outer cap top wall.

7. The child resistant closure and container combination as in claim 1 wherein said axial detent extends from said top surface of said inner cap top wall to a top surface of said at least one arcuate projection.

8. A two piece child resistant closure comprising:

a child resistant closure having an outer cap operably engaging an inner cap, said outer cap having a top wall and a first plurality of ratchet teeth and said inner cap having a top wall and a second plurality of ratchet teeth;

said first plurality of ratchet teeth and said second plurality of ratchet teeth being positionable between an on-drive position and an off-drive position, wherein an on-drive surface of said first plurality of ratchet teeth engages a corresponding first surface of said second plurality of ratchet teeth when in said on-drive position, said on-drive position permits said outer cap and said inner cap to turn as a single unit in a closing direction on said container, wherein an off-drive surface of said first plurality of ratchet teeth engages a corresponding second surface of said second plurality of ratchet teeth when in said off-drive position, said off-drive position permits said outer cap and said inner cap to turn as a single unit in an opening direction along with an axial deflection of said outer cap relative to said inner cap removing said child resistant closure from the container;

a load bearing engagement between axially aligned teeth surfaces of each of said inner cap and said outer cap prevents axial displacement of said inner cap and said outer cap when said first plurality of teeth and said second plurality of teeth are in said on-drive position;

a collar projecting downwardly from a bottom surface of said outer cap top wall, a plurality of axial ribs projecting from an inner surface of said collar;

a central post projecting upward from a top surface of said inner cap top wall, said central post having an outer perimeter, a plurality of concave recess positioned annularly about said outer perimeter of said central post, wherein a pair of adjacent said plurality of concave recesses define an arcuate flange therebetween;

each said arcuate flange having a distal end and an opposing arcuate shaped outer edge;

an axial detent projecting from said arcuate shaped outer edge of at least one of said arcuate flanges; and said axial detent of said at least one arcuate flange positioned at a first radius from a central axis of said central post and each of said plurality of axial ribs of said outer cap collar positioned at a second radius from said central axis, wherein said first radius of said axial detent is larger than said second radius of each of said plurality of axial ribs thereby said axial detent of said arcuate flange operably engages said plurality of axial ribs of said outer cap collar to resist rotation of said inner cap and said outer cap.

9. The two piece child resistant closure as in claim 8 wherein each said concave recess is offset a distance from said central axis of said central post.

10. The two piece child resistant closure as in claim 8 wherein said axial detent extends from said top surface of said inner cap top wall to a top surface of said arcuate flange.

11. The two piece child resistant closure as in claim 8 wherein each said concave recess extends vertically from said top surface of said inner cap top wall through a top surface of said arcuate flange.

12. The two piece child resistant closure as in claim 8 wherein said distal end of said arcuate flange has a first height away from said top surface of said inner cap top wall and said arcuate shaped outer edge has a second height away from said top surface of said inner cap top wall, wherein said second height is larger than said first height.

13. The two piece child resistant closure as in claim 8 wherein each said concave recess is substantially the same depth from said outer perimeter of said central post along the vertical length of said central post.

14. A child resistant closure comprising:

a child resistant closure having an outer cap operably engaging an inner cap, said outer cap having a top wall and a first plurality of ratchet teeth and said inner cap having a top wall and a second plurality of ratchet teeth;

said first plurality of ratchet teeth and said second plurality of ratchet teeth being positionable between an on-drive position and an off-drive position, wherein an on-drive surface of said first plurality of ratchet teeth engages a corresponding first surface of said second plurality of ratchet teeth when in said on-drive position, said on-drive position permits said outer cap and said inner cap to turn as a single unit in a closing direction, wherein an off-drive surface of said first plurality of ratchet teeth engages a corresponding second surface of said second plurality of ratchet teeth when in said off-drive position, said off-drive position permits said outer cap and said inner cap to turn as a single unit in an opening direction along with an axial deflection of said outer cap relative to said inner cap;

a load bearing engagement between axially aligned teeth surfaces of each of said inner cap and said outer cap prevents axial displacement of said inner cap and said outer cap when said first plurality of teeth and said second plurality of teeth are in said on-drive position;

a collar projecting downwardly from a bottom surface of said outer cap top wall, a plurality of axial ribs projecting from an inner surface of said collar;

a central post projecting upward from a top surface of said inner cap top wall, said central post having a first pair of opposing arcuate projections perpendicular to a second pair of opposing arcuate projections at a common axis, each of said arcuate projections of said first pair of opposing arcuate projections having an arcuate shaped outer edge with an axial detent projecting therefrom; and said axial detent of each said arcuate projection operably engages said plurality of axial ribs of said outer cap collar thereby resisting rotation of said inner cap and said outer cap.

15. The child resistant closure as in claim 14 wherein each of said axial detents of said first pair of opposing arcuate projections include a distal end tapered away from said inner cap top wall.

16. The child resistant closure as in claim 14 wherein a distal end of said inner surface of said outer cap collar and each of said plurality of axial ribs is tapered away from said outer cap top wall.

17. The child resistant closure and container combination as in claim 14 wherein each of said arcuate projections of said second pair of opposing arcuate projections has an arcuate shaped outer edge.

18. The child resistant closure as in claim 14 wherein each said arcuate shaped outer edge of each one of said first pair of opposing arcuate projections has a first height away from said top surface of said inner cap top wall and a distal end of each one of said first pair of opposing arcuate projections opposite said arcuate shaped outer edge has a second height away from said top surface of said inner cap top wall, wherein said first height is larger than said second height.

19. The child resistant closure as in claim 14 including a first outer diameter between said arcuate shaped outer edge of each of said first pair of opposing arcuate projections and a second outer diameter between said axial detent of each of said first pair of opposing arcuate projections, wherein said first outer diameter is smaller than said second outer diameter.

20. The child resistant closure as in claim 14 wherein each said arcuate projection has a distal end spaced from said central axis and opposite said arcuate shaped outer edge, said distal end of each said arcuate projection having a first circumferential length and said arcuate shaped outer edge having a second circumferential length, wherein said second circumferential length is larger than said first circumferential length.

21. A two piece child resistant closure comprising:

an outer cap and inner cap operably connected by a push and turn mechanism;

said outer cap having a top wall with a depending collar, said depending collar includes one or more protrusions;

said inner cap having a top wall with a projecting post, said post includes an outer cylindrical surface, said post outer cylindrical surface includes one or more recesses radially extending within said post and one or more protrusions radially projecting from said post outer cylindrical surface; and said post of said inner cap operably engages said collar of said outer cap, wherein said one or more protrusions of said inner cap post operably overlaps said one or more protrusions of said outer cap collar thereby resisting rotation of said inner cap and said outer cap.

* * * * *